US007669272B2

(12) United States Patent
Powers

(10) Patent No.: US 7,669,272 B2
(45) Date of Patent: Mar. 2, 2010

(54) METHOD OF LAUNCHING BRIDGE SPANS IN BRIDGE CONSTRUCTION

(76) Inventor: James M. Powers, 3 Santa Lucia Ave., Ormond Beach, FL (US) 32174

( * ) Notice: Subject to any disclaimer, the term of this patent is extended or adjusted under 35 U.S.C. 154(b) by 0 days.

(21) Appl. No.: 12/459,237

(22) Filed: Jun. 29, 2009

(65) Prior Publication Data

US 2009/0282626 A1 Nov. 19, 2009

Related U.S. Application Data

(63) Continuation-in-part of application No. 12/011,555, filed on Jan. 28, 2008, now abandoned.

(51) Int. Cl.
*E01D 21/00* (2006.01)

(52) U.S. Cl. ..... 14/77.1

(58) Field of Classification Search ..... 14/77.1
See application file for complete search history.

(56) References Cited

U.S. PATENT DOCUMENTS 3,299,191 A * 1/1967 Mantscheff et al. ..... 264/34
3,571,835 A * 3/1971 Buechler ..... 14/77.1
5,511,266 A * 4/1996 Dinis ..... 14/2.5
5,940,916 A * 8/1999 Sauvageot ..... 14/2.5
6,721,985 B2 * 4/2004 McCrary ..... 14/77.1
7,210,183 B2 * 5/2007 Kornatsky ..... 14/77.1
7,401,371 B2 * 7/2008 Kornatsky ..... 14/77.1
7,415,746 B2 * 8/2008 Tao ..... 14/77.1
7,520,014 B2 * 4/2009 Homsi ..... 14/77.1

* cited by examiner

*Primary Examiner*—Gary S Hartmann

(57) ABSTRACT

A method for spans launched, as self-supporting bridge beams, approximately horizontally from support structure to successive support structure without significant temporary false work or scaffolding between permanent support structures. Bridge spans assembled atop previously constructed roadbed are launched individually onto supporting structures or columns spaced at span widths beyond said roadbed. 3 individual spans are placed or assembled with a longitudinal girder into a unit atop the roadbed surface, the assembly becoming a launching truss. Load moving air cushion pallets are placed upon the roadbed beneath and before the 3 spans. The launching truss moves forward one span length beyond the roadbed end placing one span and assembled girder in cantilever. That span is disconnected from the truss and emplaced upon supporting structures, at eventual roadbed level, beyond the previously constructed roadbed. Repeated, the process completes the bridge.

7 Claims, 4 Drawing Sheets

METHOD OF LAUNCHING BRIDGE SPANS IN BRIDGE CONSTRUCTION

CROSS REFERENCE TO RELATED APPLICATIONS

This is a continuation-in-part of prior application Ser. No. 12/011,555 "METHOD OF REBUILDING A VIADUCT WITHOUT INTERRUPTING SERVICE ON THE OLD VIADUCT", filed on Jan. 28, 2008 now abandoned.

BACKGROUND OF THE INVENTION

Launching trusses have been used to great advantage in segmental concrete box beam construction of bridge spans. The most similar span launching technology to the present invention was the 2003 launching of a complete roadbed 11/2 miles across multiple spans in Millau France. A steel beam roadbed was started on each of two plateaus, facing the Tarn River Valley. The leading end of the roadbed itself was turned into a launching truss, in combination with a cable stay mast and cables. The mast was erected one half span back from the end of the span with cables arrayed supporting that half span counterbalanced by cables arrayed one half span back. As the roadbed was added to back at the plateau, hydraulic inching mechanisms at the tops of each of multiple permanent and alternating temporary half span columns, coordinated by computer, inched the whole roadbed, in one instance, for a full mile through space, till it met the advancing roadbed from the far plateau. This brilliantly creative method does incorporate roadbed structure into launching truss structure, but is superseded in economy and effectiveness by the present invention. The present invention, in a different way, also utilizes span structure as a part of the launching truss.

Air casters manufactured for the last forty years by AeroGo Inc. of Seattle Wash. are exemplary of air cushion casters referenced in this specification.

SUMMARY OF THE INVENTION

Elevated roadways such as viaducts or bridges are built using diverse designs, girder, arch, cable stay, suspension, and various self-supporting beam designs. This description refers to a method for spans launched, as self-supporting beams, approximately horizontally from support structure to successive support structure without significant temporary false work or scaffolding between permanent support structures. Bridge spans, assembled atop a short previously constructed roadbed, are launched individually onto supporting structures or columns spaced at one span intervals beyond said roadbed. The present invention utilizes span structure as a part of the launching truss. Atop the roadbed surface, approximately 3 individual spans are placed or assembled along with a longitudinal girder into a structural unit, the assembly becoming, temporarily, a launching truss. Load moving air cushion pallets are placed upon the roadbed interspersed beneath the 3 spans. The launching truss moves forward one span length beyond the roadbed end placing one span and assembled girder in cantilever. That span is disconnected from the truss and emplaced upon supporting structures, at eventual roadbed level, beyond the previously constructed roadbed.

OBJECTS AND ADVANTAGES OF THE INVENTION

Objects and advantages of the invention are:

After columns or other support structures are erected from ground or water level up to span level, very little surface construction occurs.

Surface level traffic disruption is thereby minimized.

Significant economies are achieved by fabricating span subassemblies that can then be emplaced as complete spans.

Efficient launch of full spans realizes economies of time as well as cost.

If steel spans are opted for, very long spans can be achieved by this method.

The objects and advantages of the invention are realized in a method of building a viaduct or bridge above any surface quickly and economically without significant disruption of surface activities.

REFERENCE NUMERALS IN DRAWINGS

Figure 1:
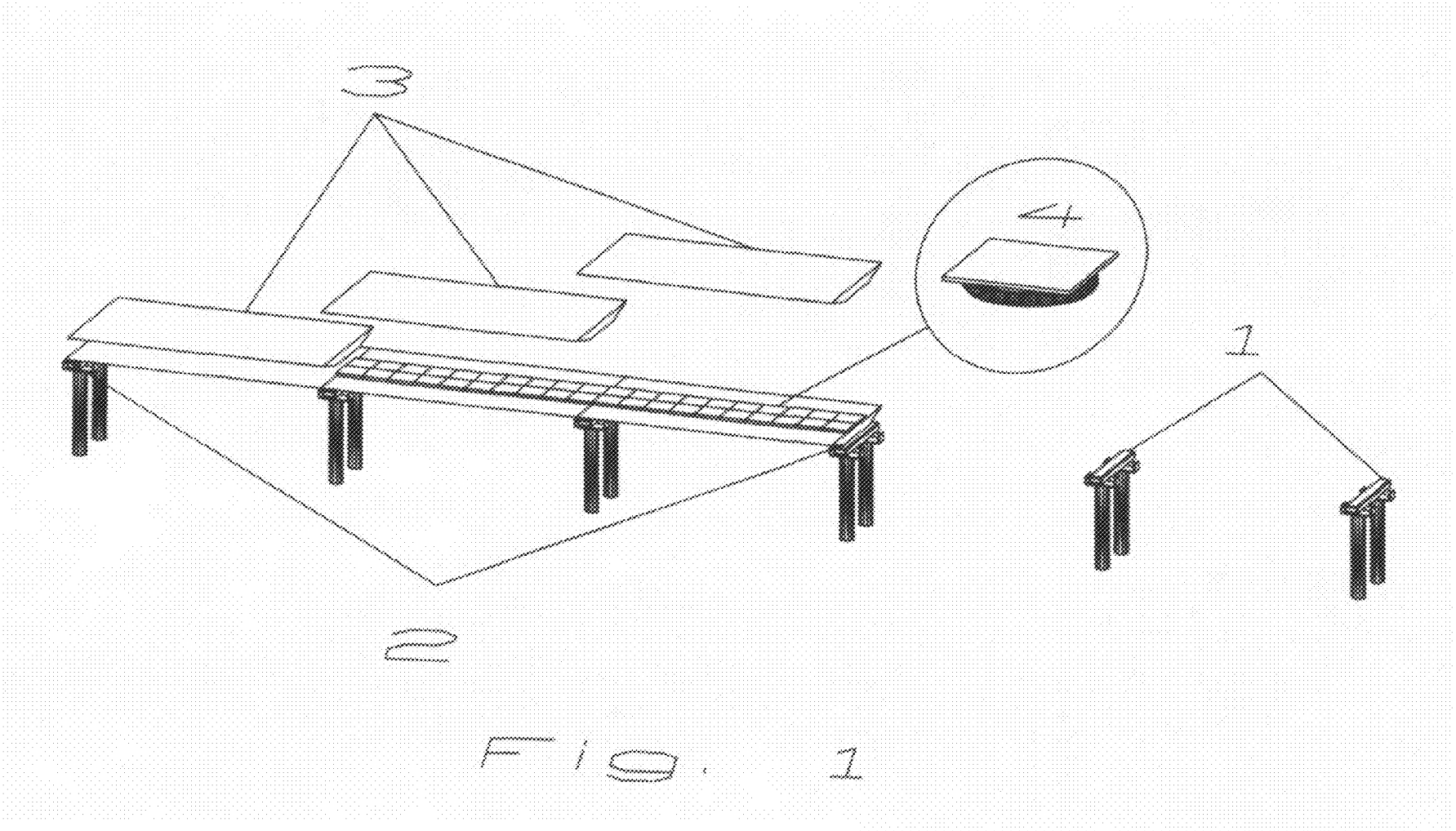
FIG. 1 is a representation of a bridge according to the invention, with 3 spans being assembled on air pallets or wheelset dollies upon a section of roadbed.
Figure 2:
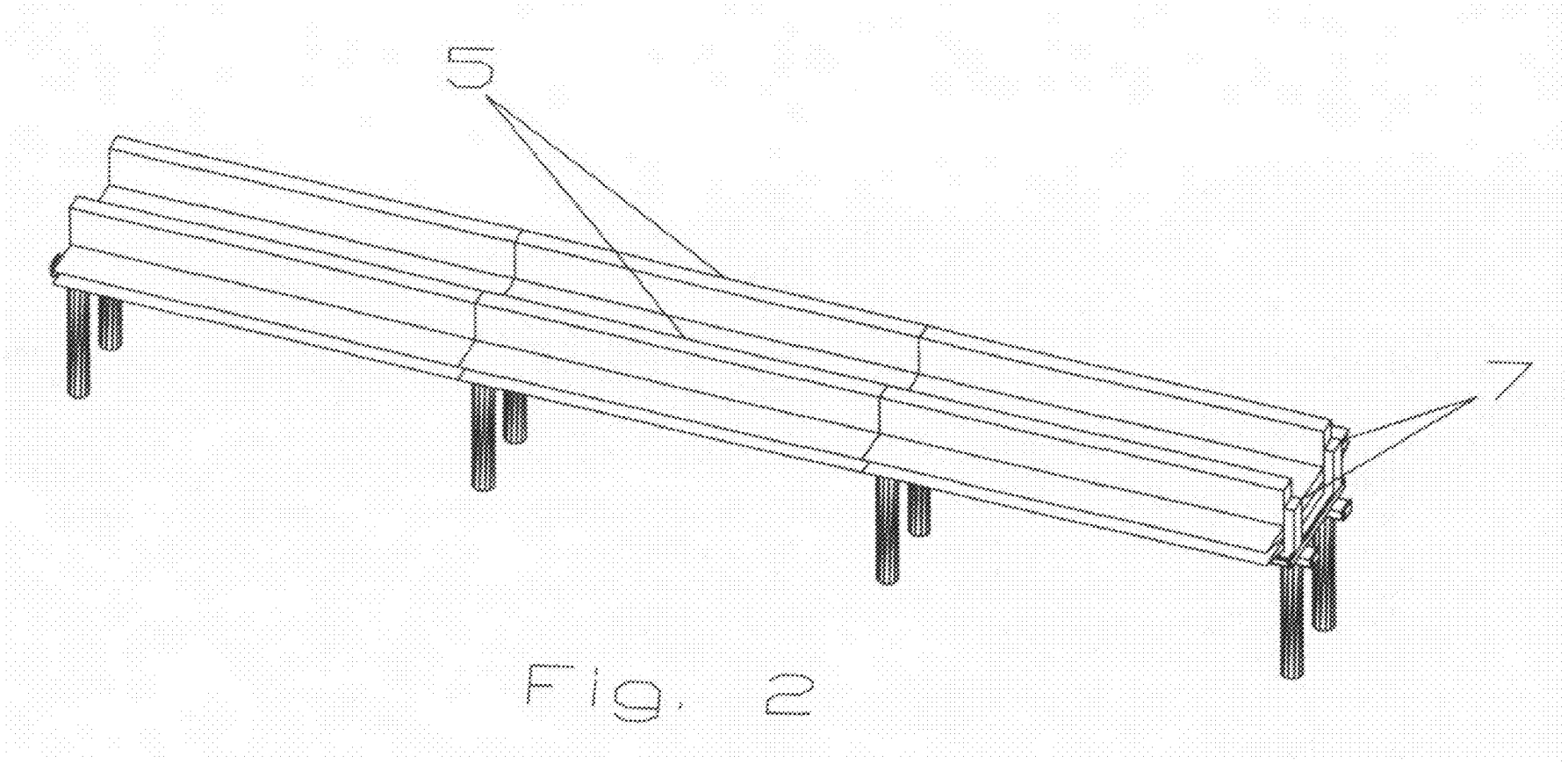
FIG. 2 is a representation of two launching girders assembled atop 3 spans assembled upon a section of roadbed
Figure 3:
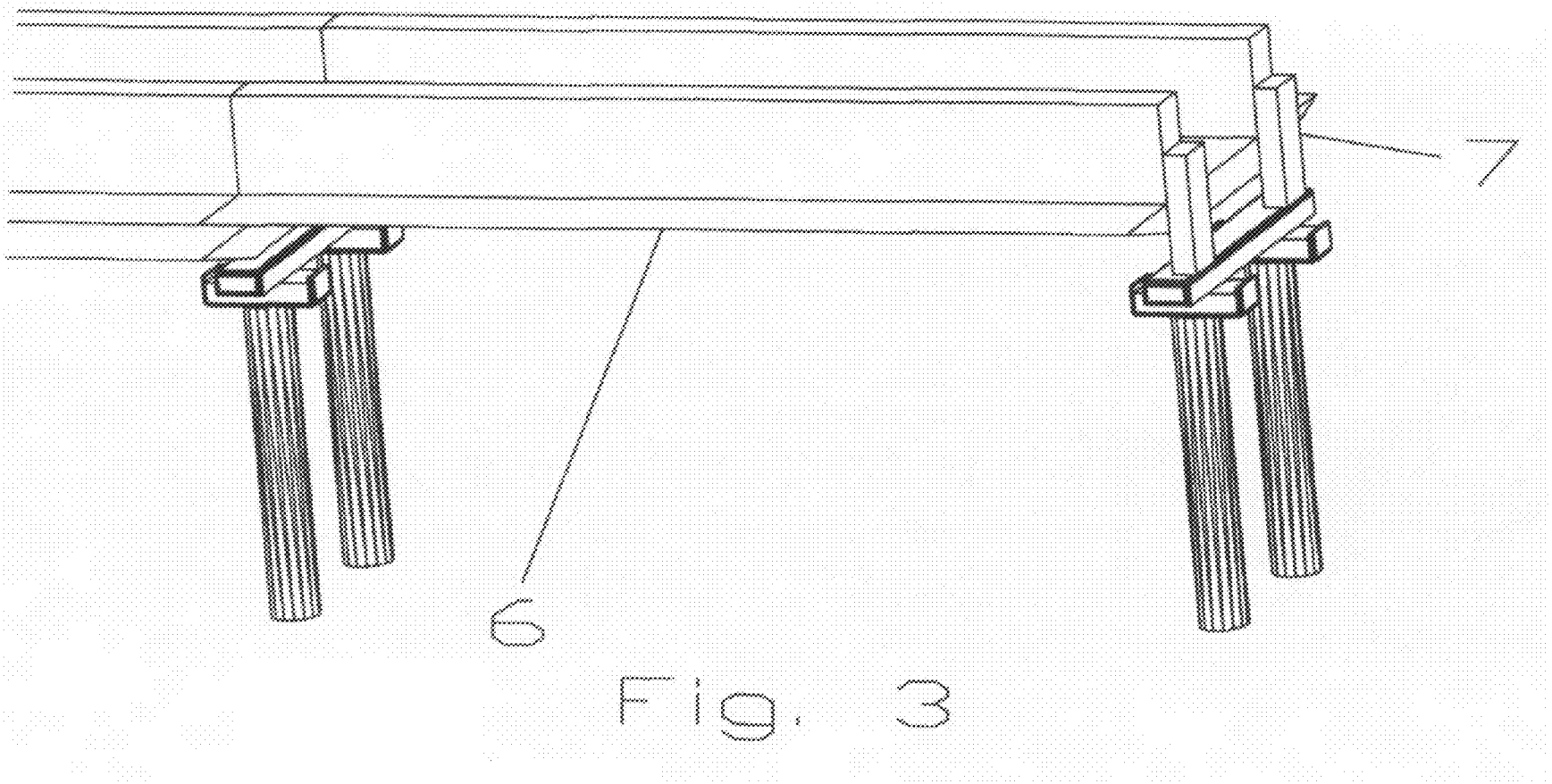
FIG. 3 is a close-up of a span in cantilever beyond an end of the roadbed with girder ends supported.
Figure 4:
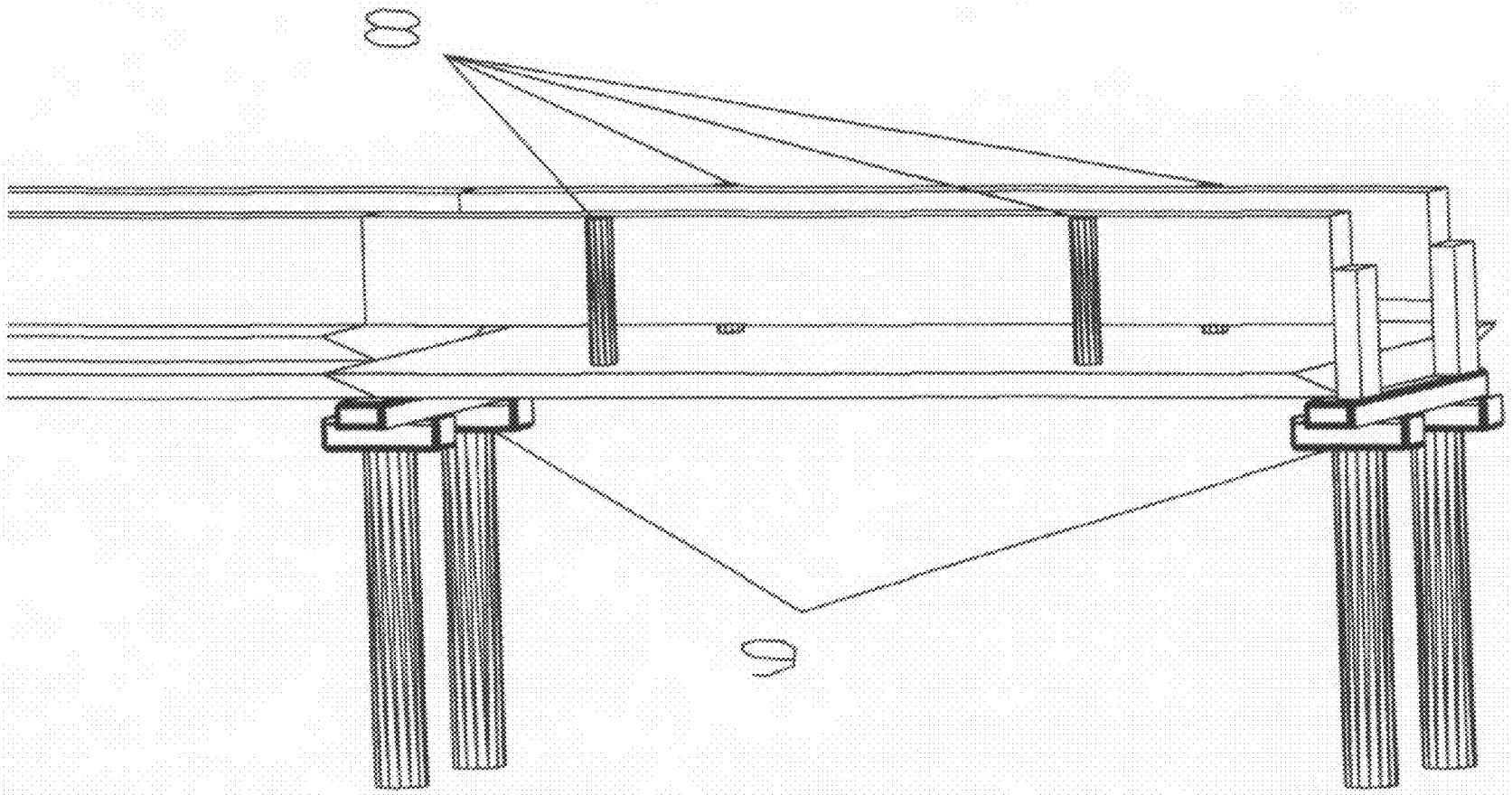
FIG. 4 is a close-up of the span, no longer in cantilever, lowered by 4 hydraulic cylinders onto final supports.

1. Bridge final supports
2. 3 span length of roadbed
3. 3 additional spans
4. Scaled popout from array of load moving air cushion pallets, or low profile dollys omnidirectional wheelsets or rollers
5. Launching girders attached to spans above roadbed
6. Span in cantilever
7. Girder end supports
8. 4 hydraulic cylinders lowering cantilever span
9. Ex cantilever span, resting on final supports

DETAILED DESCRIPTION OF PREFERRED EMBODIMENTS

A method of launching bridge spans assembled atop previously constructed roadbed (2) onto supporting structures or columns (1) arrayed at span length beyond said roadbed beginning with at least 3 span lengths of roadbed at bridge level constructed by any means. Atop the roadbed surface, approximately 3 additional spans (3) are placed or assembled together to be emplaced later, one span at a time, at eventual roadbed level beyond said previously constructed roadbed. Load moving air cushion pallets (4) are placed upon the roadbed beneath and before the additional spans. Said air cushion pallets are able to transport the considerable weight of the said approximately 3 spans to and beyond an end of the bridge. Any of various commonplace means, such as tractors or winches, is used to move the additional spans to an end of the bridge. One or more horizontal girders (5) is attached atop and extending the full length of the transported spans. The approximately 3 spans and the girders are assembled into a single truss structure with a central span and longitudinal girders lifting end spans slightly suspended above roadbed surface. The central span on its array of air cushion pallets supports all connected spans and girders upon the bridge roadbed. Said truss with connected spans and lower flanges of the girders is placed into compression and upper flanges of the girders into tension by lifting the end spans into suspension supported at the roadbed by the central span. Said moving means moves the assembled girders and spans to one span length beyond said end of the bridge putting the far end suspended span and girders in cantilever (6). Jacks or other support means (7) is emplaced between the far end of said girders in cantilever and supporting structures or columns one span length beyond the bridge roadbed whereby compression and tension are thus released from the temporary girder and span assemblage. Hydraulic cylinders (8) or other lowering means mounted on the forward end of the girders allows the weight of that now disconnected span to be transferred from any other attachments onto said lowering means. The suspended span can be lowered from girders onto the supporting structures or columns (9) and into level alignment with the bridge roadbed. The process is repeated as often as necessary while the extended spans are approximately level

DESCRIPTION OF OTHER EMBODIMENTS

Instead of air cushions, an array of low profile load moving dollys on omnidirectional wheelsets or rollers, as commonly used in the house moving industry, are interspersed between the bridge roadbed and the additional spans.

Any needed transition ramps, into a continuing roadway beyond the bridge ends, are created at bridge ends by raising or lowering a requisite length of the end roadbed spans with jacks or other common lifting means while modifying the columns or other supports to take the load.

The invention claimed is:

1. A process for building bridges, comprising the steps of:

providing approximately 3 span lengths of roadbed at bridge level constructed by other means;

providing span support structures arrayed at one span intervals along bridge route;

placing or assembling approximately 3 additional spans atop said roadbed also atop a low friction transporting means interspersed between the bridge roadbed and said additional spans;

providing motive means for moving said additional spans to an end of the roadbed;

attaching one or more horizontal girders atop and extending longitudinally along the transported spans;

providing lifting means lifting front and rear transported spans into suspension supported at the roadbed by a central span thereby placing attached transported spans and lower web of said girders into compression, also placing upper web of the girders into tension;

providing said motive means for further moving the assembled girders and spans to one span length beyond said end of the roadbed putting the far end suspended span and girders in cantilever;

providing support means between the girder ends in cantilever and said span support structures one span length beyond the bridge roadbed whereby compression and tension are released from girder and span assemblage;

providing lowering means for lowering the cantilever span from girders onto the support structures and into level alignment with the bridge roadbed; and repeating the process as often as necessary while the extended spans are approximately level.

2. The method of claim 1 in which any needed transition ramps to a continuing roadway beyond bridge ends are constructed by jacking means raising or lowering ends of and connected requisite lengths of span while modifying supports to replace jacks.

3. The method of claim 1 in which an array of load moving air cushion pallets as low friction transporting means are interspersed between the bridge roadbed and the additional spans.

4. The method of claim 1 in which an array of low profile dollys on omnidirectional wheelsets or rollers as low friction transporting means are interspersed between the bridge roadbed and the additional spans.

5. A process for launching bridge spans assembled atop previously constructed roadbed, comprising the steps of:

providing approximately 3 span lengths of said roadbed at bridge level launched or constructed by any means;

providing supporting columns spaced at one span width beyond the roadbed assembling and connecting approximately 3 additional spans atop said roadbed also atop an array of load moving air cushion pallets interspersed between the bridge roadbed and said additional spans;

providing moving means for moving the additional spans to an end of the bridge on said air cushion pallets, attaching one or more horizontal girders atop and extending the full length of the transported spans;

providing means for lifting two end spans of the additional spans attached to said girders into suspension slightly above the roadbed supported at the roadbed by a central span thereby placing the attached spans and lower web of said girders into compression and the upper web of the girders into tension;

providing said moving means for moving the assembled girders and spans one span length beyond said end of the roadbed putting the far end suspended span and girders in cantilever, providing support means between the far end of said girders otherwise in cantilever and specific supporting columns one span length beyond the end of the bridge roadbed thereby compression and tension are released between girder and span assemblage, and providing hydraulic cylinders for lowering said cantilever span from girders onto the supporting columns and into level alignment with the bridge roadbed, and repeating the process as often as necessary while the extended spans are approximately level.

6. The method of claim 5 in which any needed transition ramps to a continuing roadway at bridge ends are constructed by lifting means raising or lowering ends and connected requisite lengths of span while modifying supporting columns to replace said lifting means.

7. The method of claim 5 in which an array of load moving dollys on omnidirectional wheelsets or rollers instead of the air cushion pallets are interspersed between the bridge roadbed and the additional spans.

* * * * *